US009513654B2

(12) United States Patent
Strof

(10) Patent No.: US 9,513,654 B2
(45) Date of Patent: Dec. 6, 2016

(54) METHOD FOR PERFORMING A SWITCHING PROCESS IN AN ON-LOAD TAP CHANGER

(71) Applicant: Maschinenfabrik Reinhausen GmbH, Regensburg (DE)

(72) Inventor: Thomas Strof, Gumpoldskirchen (AT)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 0 days.

(21) Appl. No.: 14/772,021

(22) PCT Filed: Mar. 21, 2014

(86) PCT No.: PCT/EP2014/055733

§ 371 (c)(1),
(2) Date: Sep. 1, 2015

(87) PCT Pub. No.: WO2014/161729

PCT Pub. Date: Oct. 9, 2014

(65) Prior Publication Data

US 2016/0018840 A1 Jan. 21, 2016

(30) Foreign Application Priority Data

Apr. 4, 2013 (DE) ..... 10 2013 103 360

(51) Int. Cl.
*G05F 5/00* (2006.01)
*H01F 29/04* (2006.01)

(52) U.S. Cl.
CPC ..... *G05F 5/00* (2013.01); *H01F 29/04* (2013.01)

(58) Field of Classification Search
CPC ..... G05F 5/00; H01F 29/04
See application file for complete search history.

(56) References Cited

U.S. PATENT DOCUMENTS

| | | | | |
|---|---|---|---|---|
| 5,604,424 | A * | 2/1997 | Shuttleworth | H01F 29/04 323/258 |
| 6,060,669 | A | 5/2000 | Dohnal | |
| 9,030,175 | B2 | 5/2015 | Wrede | |
| 2005/0269191 | A1* | 12/2005 | Lindsey | H01H 9/0044 200/18 |
| 2008/0302639 | A1* | 12/2008 | Baertl | H01H 19/62 200/18 |

FOREIGN PATENT DOCUMENTS

| | | | |
|---|---|---|---|
| GB | 1164782 | A | 9/1969 |
| GB | 2014794 | A | 8/1979 |

* cited by examiner

*Primary Examiner* — Jue Zhang
(74) *Attorney, Agent, or Firm* — Andrew Wilford

(57) ABSTRACT

The invention relates to a method for performing a switching process in an on-load tap changer between winding taps of a tapped transformer. The switching process for an on-load tap changer is subdivided into a plurality of phases according to the reactor switching principle. In these phases, the switching contacts in use are monitored during the actuation and are completely opened or closed by capacitors in the controller in the event of failure of the energy supply. Thereby critical switching states are prevented.

10 Claims, 3 Drawing Sheets

METHOD FOR PERFORMING A SWITCHING PROCESS IN AN ON-LOAD TAP CHANGER

CROSS REFERENCE TO RELATED APPLICATIONS

This application is the US-national stage of PCT application PCT/EP2014/055733 filed 21 Mar. 2014 and claiming the priority of German patent application 102013103360.1 itself filed 4 Apr. 2013.

FIELD OF THE INVENTION

The invention relates to a method of switching an on-load tap changer between winding taps of a tapped transformer.

BACKGROUND OF THE INVENTION

On-load tap changers have been in worldwide use in large numbers for many years for uninterrupted switching between different winding taps of tapped transformers. So-called reactor changers, which are widespread particularly in North America, comprise a switching reactance enabling a slow, continuous switching. On-load tap changers according to the resistance rapid-switching principle usually consist of a selector for power-free selection of the respective winding tap of the tapped transformer which is to be switched over to and a load changeover switch for the actual switching from the previous to the new, preselected winding tap. The load changeover switch for that purpose usually comprises switches and resistance contacts. The switches then serve for direct connection of the respective winding tap with the load diverter and the resistance contacts for temporary connection, i.e. bridging over by one or more switch-over resistances. However, developments in recent years have led away from load changeover switches with mechanical switches in insulating oil. Instead, increasing use is made of vacuum switching cells as switching elements.

An on-load tap changer with vacuum interrupters is known from, for example, DE 10 2009 043 171 [U.S. Pat. No. 9,030,175]. Here, a load changeover switch carries a drive shaft that is drivable by a force-storing unit with at least one cam disc. The cam disc has a plurality of cams, wherein two cams arranged on the cam disc at the end have a contour that departs from a circular shape in the manner of lobes at which a respective roller connected with a vacuum interrupter by a rocker lever is guided under maintained contact, which roller tracks the profiled contour of the respective cam.

Due to the constructional configuration of this on-load tap changer this requires a spring force-storing unit for abrupt switching by the contact system. Force-storing units known from the prior art are pulled up, i.e. stressed, by a drive shaft at the start of each actuation of the on-load tap changer. The known force-storing units essentially consist of a pull-up carriage and a jump carriage between which energy storage springs as force-storing unit are arranged.

Force-storing units of that kind are evident from, for example, DE 198 55 860 and DE 28 06 282 [GB 2014794]. Despite these force-storing units used over decades there is repeated failure of these devices. Since the on-load tap changer is in use over a lengthy period of time the compression or tension springs repeatedly break and thus prevent switching. Moreover, it can happen that a carriage does not reach the end position, the switching shaft thus does not completely rotate and the switches do not reach the end position thereof. In the worst case this can lead to destruction of the entire tapped transformer.

By comparison with the prior art, the latest on-load tap changer models of the applicant do not have a mechanical force-storing unit for performance of switching processes. Actuation takes place directly by an electric drive. In the event of sudden failure of the energy supply for such a drive during a switching process, however, critical settings in the on-load tap changer can arise. These are, in particular, shortly before closing or after opening of a switch. In that case, it is possible, for example, for welding of the contacts inside the vacuum interrupter to occur.

OBJECT OF THE INVENTION

The object of the invention is thus to provide a method of switching an on-load tap changer in order to thereby increase the reliability of on-load tap changers.

SUMMARY OF THE INVENTION

This object is fulfilled by a method of carrying out a switching process of an on-load tap changer in which the switching sequence on which the switching process is based into a plurality of phases is divided, critical and non-critical switching states of the respectively used switches are identified, each of these phases is monitored during a switching process and, in dependence on a decision logic which is parameterized in a controller, the value of the supply voltage that is detected by a voltage monitoring device at the start of an intended switching process is processed as a decision basis and the switching process or entering the next defined phase of the switching process is started only if a supply voltage is detectable, and in addition, in the case of a voltage drop of the mains or supply voltage and thus in the case of failure of the energy supply of the electric drive during a switching process, the respective critical switching states that are identified for a switching sequence of the respective switches are overcome with the help of the energy present in the capacitors of the controller in that switching onward to the succeeding phase that is identified as non-critical of the switching states is carried out.

According to the invention, in that case after initiation of the switching to the first phase it is checked by a voltage monitoring device whether a voltage is present at a selected phase line. If a voltage is not present, the switching is broken off and is continued when voltage is present.

During the second phase of the method according to the invention an electric drive is actuated by a controller and in that case opens the second switch. During the opening, the energy supply of the electric drive is monitored by a controller. In the case of a voltage drop at the energy supply of the electric drive, energy from the capacitors of the controller is used for full opening of the second switch. Subsequently, thus during the third phase, movement to an adjacent winding tap by a second selector contact is carried out.

During the fourth phase of the method according to the invention the electric drive is actuated by a controller and in that case the second switch closed. During the closing, the energy supply of the electric drive is monitored by the controller and in the case of voltage drop of the energy supply of the electric drive the energy from capacitors of the controller is used for full closing of the second switch.

During the fifth phase of the method according to the invention the first selector contact is in contact with a winding tap and the second selector contact is in contact with the adjacent winding tap. The first and second switches are in that case closed. During this time a circular current Ik arises.

During the sixth phase of the method according to the invention it is checked, before continuation of switching, by the voltage monitoring device whether a voltage is present at a selected phase line. If a voltage is not present, the switching is broken off; if voltage is present it is continued. During the seventh, following phase an adjacent winding tap is moved to by the first selector contact.

During the eighth phase of the method according to the invention the electric drive is actuated by a controller and the first switch closed. During the closing, the energy supply of the electric drive is monitored by a controller and in the case of a voltage drop at the energy supply of the electric drive the energy from capacitors of the controller is used for full closing of the first switch. The switching is concluded in the ninth phase.

BRIEF DESCRIPTION OF THE DRAWING

The method according to the invention shall be explained in more detail by way of example in the following, in which.

SPECIFIC DESCRIPTION OF THE INVENTION

Figure 1:
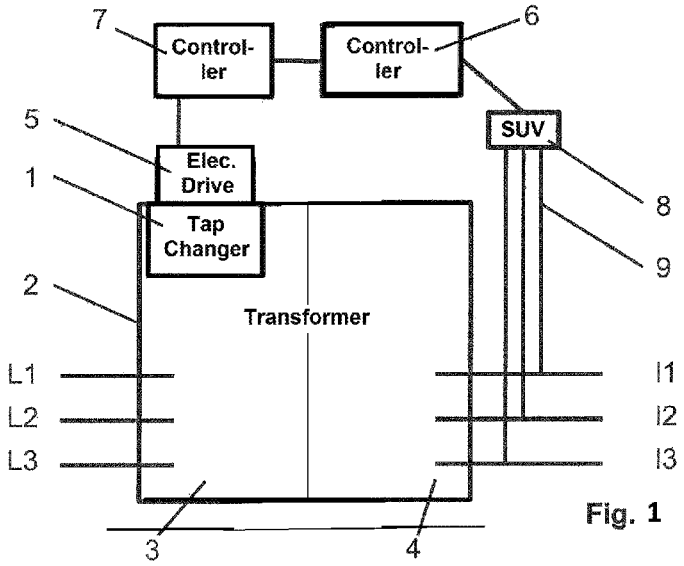
FIG. 1 is a schematic view of an on-load tap changer with necessary means for performance of the switching process in which critical settings are avoided.

An on-load tap changer 1 in a tapped transformer 2 according to the reactor switching principle is illustrated in FIG. 1. The tapped transformer 2 has a high-voltage side 3 on which the on-load tap changer 1 is mounted and a low-voltage side 4. Both the high-voltage side 3 and the low-voltage side 4 each have three respective phase lines L1, L2, L3, I1, I2, I3. The on-load tap changer 1 is actuated by an electric drive 5. A controller 6 initiates the individual switching actions of the electric drive 5. The controller 6 is connected with the electric drive 5 by another controller 7 and with a voltage monitoring device 8, termed SUV 8 in the following. The SUV 8 monitors the voltage of the individual phase lines I1, I2 and I3 on the low-voltage side 4. The energy supply of the electric drive 5 takes place through one of these phase lines I1 of the low-voltage side 4 via a line 9. However, any of the phase lines I1, I2 and I3 present on the low-voltage side 4 is suitable for that purpose.

Buffer capacitors capable of storing a defined amount of energy are provided inside the controller 6. These are often components of the controller 6, but can also be retrofitted. On initiation of a switching process of the on-load tap changer 1, from a tap n by an intermediate step n+½ to a next tap n+1 of the tapped transformer, the energy from a phase line I1, I2 or I3 is used for the purpose of opening or closing the switches V1, V2, particularly vacuum interrupters, inside the on-load tap changer 1. The critical settings arise in this switching process particularly in the case of so-called hard opening or hard closing of the switches. Hard opening or closing arises wh\ase the contacts are under load, i.e. conduct current. In that case, arcs, which have an effect on the service life of the contacts and in the case of a longer period of burning can even lead to destruction, arise inside the switches.

An exemplifying switching process of an on-load tap changer 1 operating in accordance with the reactor switching principle is illustrated in FIGS. 2*a*-2*i*. The on-load tap changer 1 consists of a first switch V1 and a second switch V2, a first movable selector contact W2 and a second movable selector contact W2, as well as a first switching reactance X1 and a second switching reactance X2. In addition, a load diverter Y is arranged between the first and second reactances X1 and X2. The switching process takes place from a first tap n of a tap winding to an adjacent, second winding tap n+1 of a tap winding of a tapped transformer 2, wherein an intermediate setting n+½ is permissible as a static operational setting.

Figure 2A:
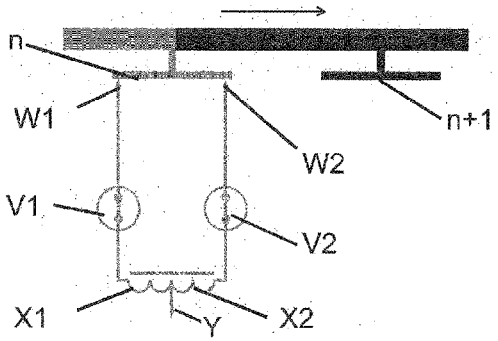
FIGS. 2*a*-2*i* illustrate an embodiment of a switching process of an on-load tap changer operating according to the reactor switching principle.
Figure 2B:
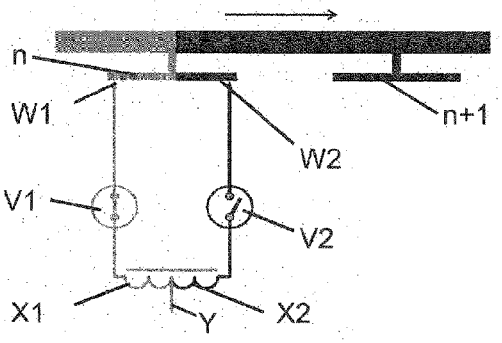
Figure 2C:
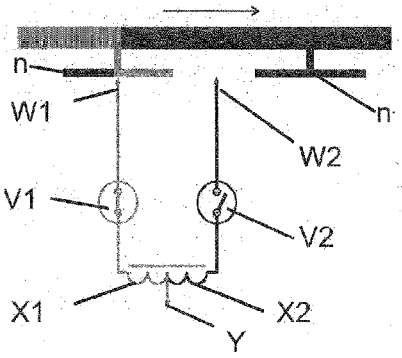
Figure 2D:
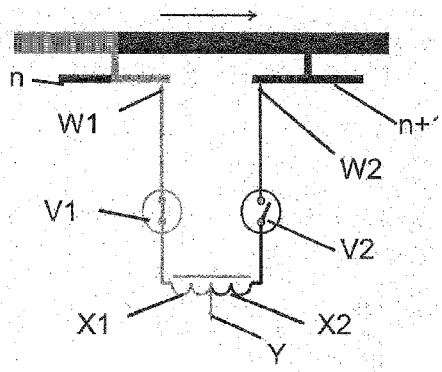
Figure 2E:
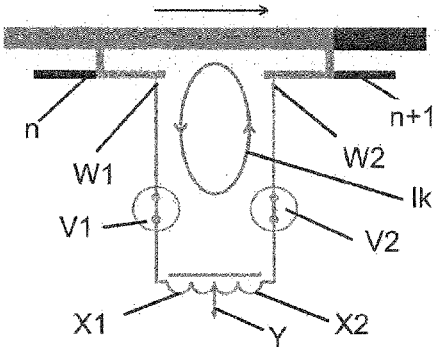
Figure 2F:
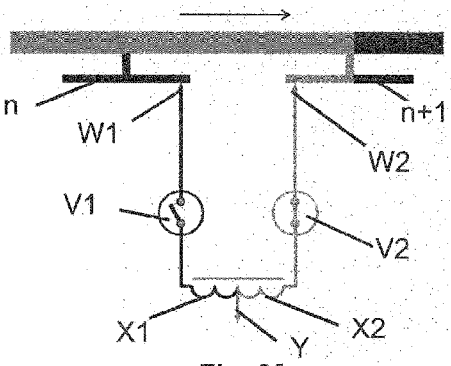
Figure 2G:
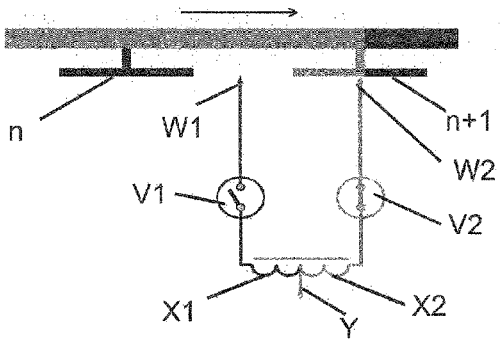
Figure 2H:
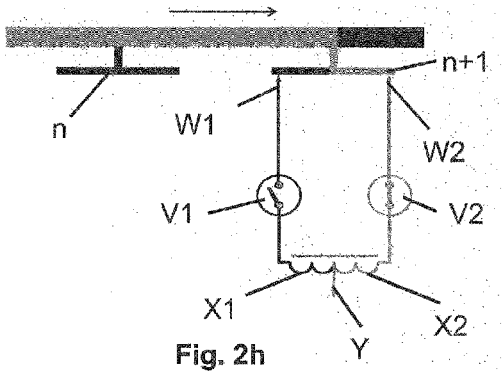
Figure 2I:
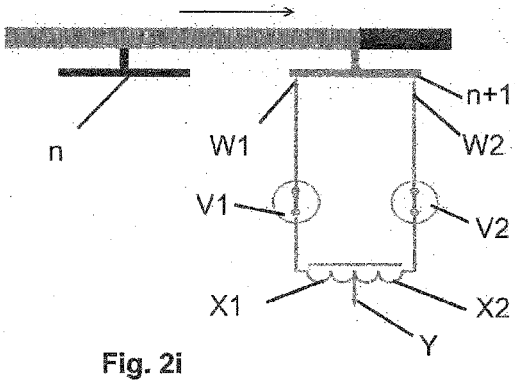

At the start of a switching process, FIG. 2*b*, the second switch V2 is opened so that the second selector contact W2 can initially be detached free of current from the winding tap n. Subsequently, FIG. 2*c*, the selector contact W2 moves to the second tap n+1. After reaching the second winding tap n+1, FIG. 2*d*, the switch V2 is closed. In that case, a so-called circular current Ik arises, FIG. 2*e*. The reactances X1 and X2 make it possible for the on-load tap changer 1 to remain in this position. This setting is termed intermediate step n+½. After opening of the first vacuum interrupter V1, FIG. 2*f*, the circular current Ik is interrupted and the first selector contact W1 moves in the direction of the second winding tap n+1, FIG. 2*g*. As soon as the first selector contact W1 has reached the winding tap n+1, FIG. 2*h* and FIG. 2*i*, the first switch V1 is closed.

According to the invention this switching process can thus be divided into nine phases. In the first phase (I) (FIG. 2*a*), the switching is initiated. In the second phase (II) the second switch V2 is opened. In the third phase (III) (FIG. 2*c*) the adjacent, second winding tap n+1 is moved to by the second selector contact W2. In phase four (IV), the second switch V2 is closed. In phase five (V) (FIG. 2*d*) both switches V1 and V2 are closed. In phase six (V1) the first switch V1 is opened. In phase seven (VII) (FIG. 2*g*) the first selector contact W1 moves to the adjacent, second winding tap n+1. In phase eight (VIII) the first switch V1 is closed. In phase nine (IX) the switching process is ended.

Figure 3:
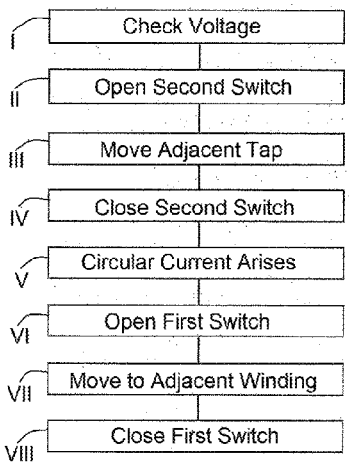
FIG. 3 is a schematic flowchart with different phases during a switching process.

The method according to the invention is illustrated in FIG. 3 by a schematic flowchart. In that case, on initiation of the switching process in the first phase (I) it is initially checked by the SUV 8 whether a voltage is present at the phase line I1, I2, I3 selected for the energy supply. If this not the case, the switching process is not continued and the on-load tap changer 1 remains in this position or the entire tapped transformer 2 is switched off. If a voltage is present, the electric drive 5 is actuated by the controller 6.

During this second phase (II) the second switch V2 is opened. This phase is regarded as a critical switching state, since non-quenching of the arc can occur if the second switch V2 is not fully opened. The controller 7 during this time monitors the energy supply of the electric drive 5. If during this phase (II) a voltage drop, thus failure of the energy supply, occurs this is detected by the controller 7 and compensation is provided with the help of the energy that is present in the controller 6 from the already previously charged capacitors, i.e. the second switch V2 is fully opened.

When the opening is completely concluded, the adjacent tap n+1 is moved to by the second selector contact W2 in the third phase (III). During closing of the second switch V2, thus in phase four (IV), the energy supply is monitored by the controller 7. This phase (IV) is similarly regarded as a critical switching state, since pre-ignition and subsequent non-quenching of the arc can occur if the second switch V2 is not completely closed. In the case of a voltage drop, thus failure of the energy supply, this is detected by the controller 7 and compensation is provided with the help of the energy that is present in the controller 6 from the already previously charged capacitors, i.e. the second switch V2 is fully closed. In the fifth phase (V), thus after the second switch V2 was closed, the so-called circular current Ik arises. This switching state is non-critical.

Prior to opening of the first switch V1, thus phase six (VI), it is checked again whether a voltage is present at the phase line I1, I2, I3 selected for energy supply. If this is not the case, the switching process is not continued and the on-load tap changer remains in this position or the entire tapped transformer is switched off. In phase seven (VII) the adjacent winding tap n+1 is moved to. In the eighth phase (VIII) the first switch V1 is closed. During this time the controller 7 monitors the energy supply of the electric drive 5. If during this phase a voltage drop, thus failure of the energy supply, occurs this is detected by the controller 7 and compensation is provided with the help of the capacitors present in the controller 6 and already previously charged. The switching process is concluded in the last phase.

With the help of the method according to the invention it is always ensured that the first and second switches V1 and V2 never adopt a critical switching state during a switching process of an on-load tap changer 1 from a winding tap n to a next winding tap n+1. Thus, destruction of the switches V1 and V2, the on-load tap changer 1 or even the entire tapped transformer 2 is prevented. This would have disastrous effects on an energy supply mains.

| Phases of the switching | |
|---|---|
| I | initiation of switching |
| | checking the voltage of a selected phase line by SUV |
| | carrying out switching when voltage is present |
| | breaking-off the switching when the voltage is not present |
| II | actuating the electric drive by a control |
| | opening the second switching contact |
| | monitoring the voltage by a controller |
| | using the energy of the capacitors from the control, in the case of voltage drop, for full opening of the second switching contact |
| III | movement to the adjacent winding tap by the second selector contact |
| IV | actuation of the electric drive by a control |
| | closing the second switching contact |
| | monitoring the voltage by a controller |
| | using the energy of the capacitors from the control, in the case of voltage drop, for full closing of the second switching contact |
| V | maintenance with fully closed switching contacts |
| | creation of the circular current |
| | checking the voltage of a selected phase line by SUV |
| | performing the switching when voltage is present |
| | breaking-off the switching when voltage is not present |
| VI | actuating the electric drive by a control |
| | opening the first switching contact |
| | monitoring the voltage by a controller |
| | using the energy of the capacitors from the control, in the case of voltage drop, for full opening of the first switching contact |
| VII | movement to the adjacent winding tap by the first selector contact |
| VIII | actuation of the electric drive by a control |
| | closing the first switching contact |
| | monitoring the voltage by a controller |
| | using the energy of the capacitors from the control, in the case of voltage drop, for full closing of the first switching contact |
| IX | concluding the switching |

The invention claimed is:

1. A method of switching an on-load tap changer between winding taps of a tapped transformer by switches, the method comprising the steps of:

dividing the switching process into a plurality of phases, identifying critical and non-critical switching states of the switches, monitoring each of the phases, detecting at the start of an intended switching process a value of the supply voltage as a decision basis by a voltage monitoring device in dependence on a decision logic parameterized in a controller and switching to a next defined phase of the switching process only if the supply voltage is present, and overcoming in the case of a voltage drop in the supply voltage and thus in the case of failure of the energy supply of the electric drive during a switching process, the respective critical switching states that are identified for a switching sequence of the respective switches with the help of the residual energy present in capacitors of the controller in that switching to the succeeding phase that is identified as non-critical of the switching states is carried out.

2. The method according to claim 1, further comprising the step, after initiation of switching to a first phase, of;

checking with a voltage monitoring device whether a voltage is present at a selected phase line, interrupting switching if a voltage is not present, and continuing the switching if voltage is present.

3. The method according to claim 1, further comprising, during a second phase, the step of:

actuating an electric drive by a controller and thereby opening the second switch, during the opening, monitoring the energy supply of the electric drive with a controller and in the case of a voltage drop at the energy supply of the electric drive, using energy from capacitors of the controller for full opening of the second switch.

4. The method according to claim 1, further comprising, during a third phase, the step of:

moving a second selector contact to an adjacent winding tap.

5. The method according to claim 1, further comprising, during a fourth phase, the steps of:

actuating the electric drive by a controller to close the second switch, monitoring the energy supply of the electric drive by the controller during the closing, and, in the case of a voltage drop at the energy supply of the electric drive, using energy from capacitors of the controller for full closing of the second switch.

6. The method according to claim 1, further comprising, during a fifth phase, the steps of:

contacting a first selector contact with a winding tap and a second selector contact with an adjacent winding tap, and closing the first and second switches, such that a circular current arises.

7. The method according to claim 1, further comprising, during a sixth phase, the steps of:

checking with the voltage monitoring device before continuing the switching whether a voltage is present at a selected phase line, interrupting the switching if a voltage is not detected, and continuing the switching if a voltage is detected.

8. The method according to claim 1, further comprising, during a seventh phase, the step of:

moving a first selector contact to an adjacent winding tap.

9. The method according to claim 1, further comprising, during an eighth phase, the steps of:

actuating the electric drive by a controller so as to close the first switch, monitoring the energy supply of the electric drive by a controller during the closing, and in the case of a voltage drop at the energy supply of the electric drive, using energy from capacitors of the controller for full closing of the first switch.

10. The method according to claim 1, further comprising, in a ninth phase, the step of:

terminating the switching.

* * * * *